United States Patent [19]

Peilet

[11] 4,147,174

[45] Apr. 3, 1979

[54] SELF-CLEANING RETRACTABLE COMB

[76] Inventor: Lester R. Peilet, 6144 N. Talman Ave., Chicago, Ill. 60659

[21] Appl. No.: 809,061

[22] Filed: Jun. 22, 1977

[51] Int. Cl.[2] ..... A45D 24/42

[52] U.S. Cl. ..... 132/119; 15/185

[58] Field of Search ..... 132/119, 11 R, 129, 132/132–133, 143; 15/169, 185

[56] References Cited

U.S. PATENT DOCUMENTS

| | | | |
|---|---|---|---|
| 257,033 | 4/1882 | Lowe | 132/132 |
| 2,110,294 | 3/1938 | Gessner | 132/119 |
| 2,260,093 | 10/1941 | Rainville | 132/143 |
| 2,610,638 | 9/1952 | Franklin | 132/119 |
| 3,765,049 | 10/1973 | Green | 132/119 |

FOREIGN PATENT DOCUMENTS

| | | | |
|---|---|---|---|
| 860787 | 10/1940 | France | 132/28 |

*Primary Examiner*—G. E. McNeill

*Attorney, Agent, or Firm*—Burmeister, York, Palmatier, Hamby & Jones

[57] ABSTRACT

The disclosed self-cleaning retractable comb comprises an elongated member made of flexible resilient resinous plastic material and comprising a comb portion and body portion at opposite ends thereof, with a handle portion extending between said comb portion and said body portion. The comb portion is formed with a plurality of comb teeth which are slidably received in openings formed in a lower wall on said body portion. The comb portion and the teeth are movable between an extended position, in which the teeth are extended through the openings, and a retracted position in which the tips of the teeth are retracted into the openings. The handle portion is flexed into a generally U-shaped loop and is effective to bias the comb portion toward its retracted position. The body portion has sidewall means for enclosing the teeth, when retracted, and stop means for limiting the retraction of the comb portion. Preferably, the body portion comprises detent elements for detaining the comb portion in its extended position.

12 Claims, 12 Drawing Figures

26
50
52
8
6
56
60
20

9
7
42
24
22
30

10°
32
28

44
36
48

34

SELF-CLEANING RETRACTABLE COMB

This invention relates to a self-cleaning retractable comb, intended primarily for the grooming of human hair, but also useful for the grooming of animal hair.

One object of the present invention is to provide a new and improved comb having teeth which are retractable after use, and having means whereby the teeth are automatically cleaned as they are retracted, so that loose hair and other foreign materials are stripped from the teeth. In this way, the comb is self-cleaning.

A further object is to provide such a new and improved self-cleaning retractable comb which is compact, easily used, attractive in appearance and low in cost.

In accordance with the present invention, the self-cleaning retractable comb preferably comprises an elongated member made in one piece of a flexible resilient resinous plastic material. The member has a comb portion and a body portion at its opposite ends, and also a flexible handle portion extending between the comb portion and the body portion. The comb portion has a plurality of comb teeth formed integrally thereon and arranged in a longitudinal row. The body portion has a lower wall formed with a plurality of openings in which the comb teeth are slidably received for extending and retracting movement between an extended position, with the teeth projecting through the openings, and a retracted position, with the tips of the teeth retracted into the openings. The body portion has sidewall means for enclosing the teeth when they are in the retracted position. The handle portion is flexed into a loop which is generally U-shaped when the comb teeth are in the retracted position. The handle portion serves as a spring for biasing the comb portion and the teeth toward the retracted position. The teeth may be extended by squeezing the handle portion. The comb portion and the body portion have stop means for limiting the retracting movement of the comb portion. Preferably, the body portion and the comb portion have detent means for detaining the comb portion in its extended position, with the comb teeth projecting through the openings in the lower wall of the body portion.

When the teeth are retracted, any loose hair and other foreign materials are stripped from the teeth by the body portion. Thus, the retractable comb is self-cleaning as it is retracted.

Further objects, advantages and features of the present invention will appear from the following description, taken with the accompanying drawings, in which.

Figures 1, 2, 3, 4, 5:
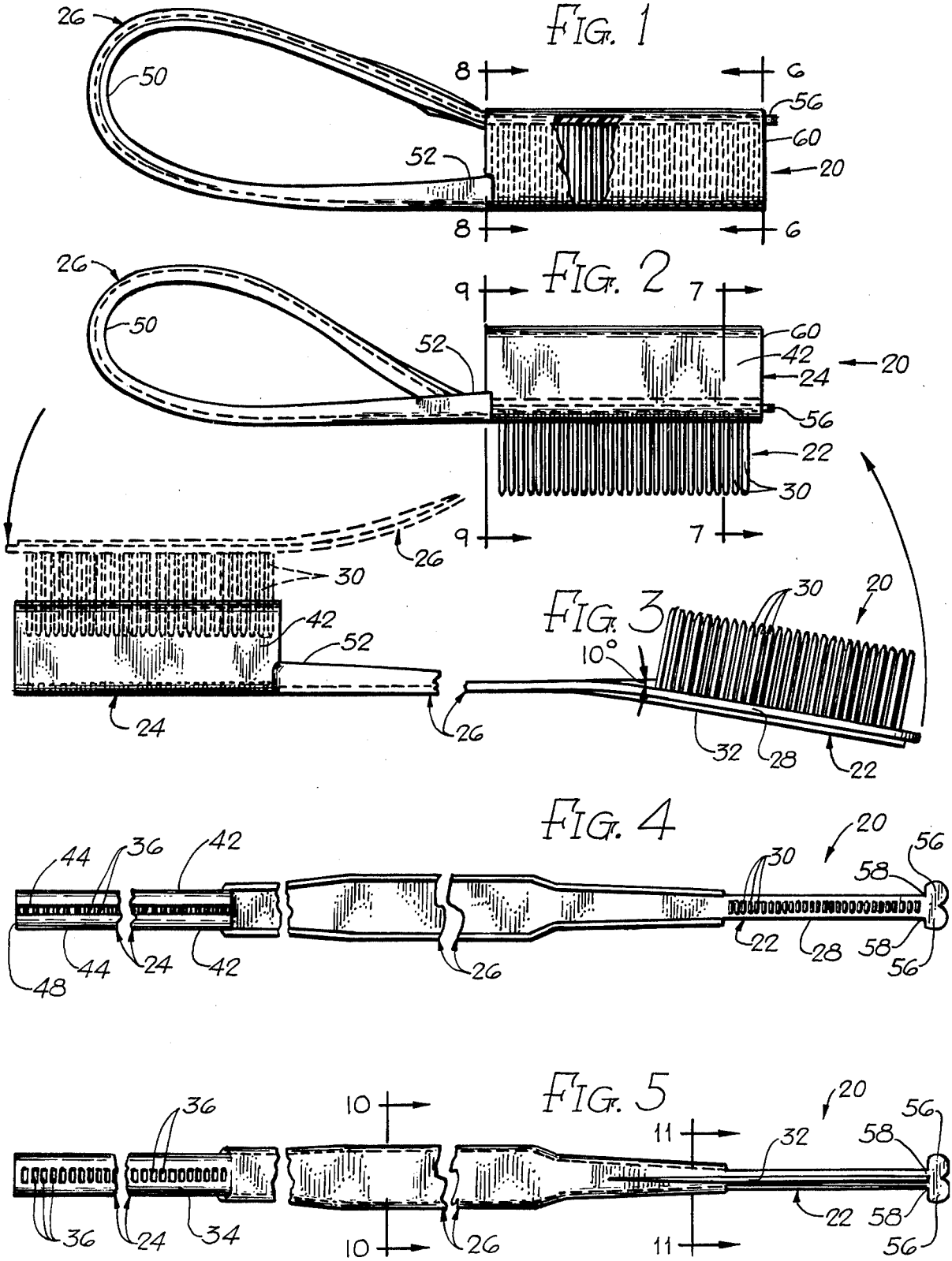
FIG. 1 is a side elevation of a self-cleaning retractable comb to be described as an illustrative embodiment of the present invention, the comb being shown in its retracted position.
FIG. 2 is a view similar to FIG. 1, but with the comb in its extended position.
FIG. 3 is a fragmentary elevation showing the retractable comb as molded, before the handle portion is flexed, and before the comb teeth are assembled into the body portion of the comb.
FIG. 4 is a top plan view of the comb as shown in FIG. 3.
FIG. 5 is a bottom plan view of the comb as shown in FIG. 3.
Figure 10:
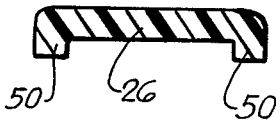
Figure 11:
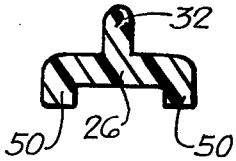

FIGS. 10 and 11 are cross-sections taken through the handle portion, generally along the lines 10—10 and 11—11, respectively, in FIG. 5.

Figure 9:
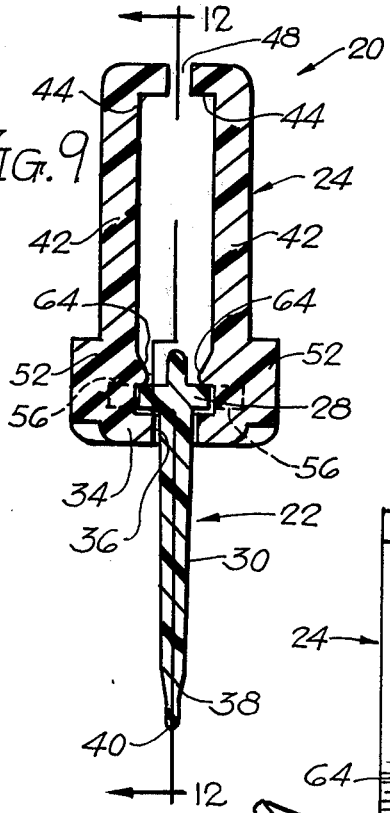
FIG. 9 is a vertical section taken generally along the line 9—9 in FIG. 2, the comb being shown in its extended position.
Figure 12:
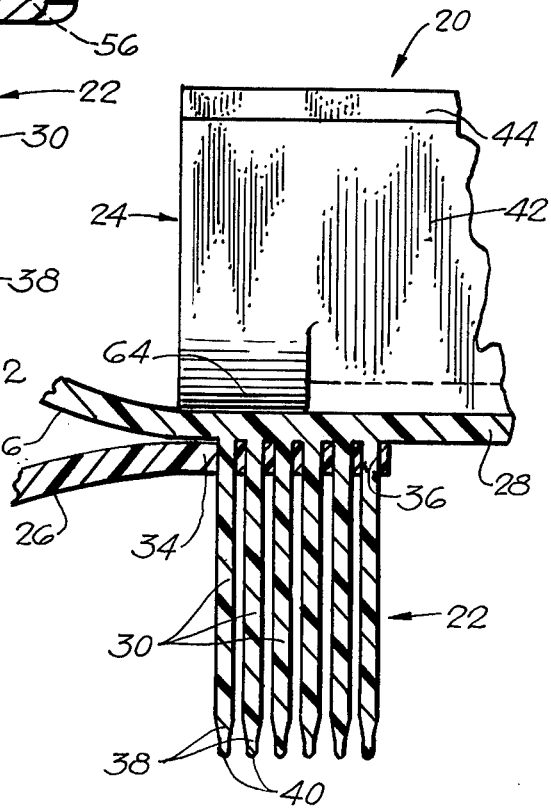

FIG. 12 is a fragmentary enlarged longitudinal section, taken generally along the line 12—12 in FIG. 9.

As just indicated, the drawings illustrate a self-cleaning retractable comb 20, which is preferably molded in one piece from a flexible resilient resinous plastic material, such as polyethylene or polypropylene, for example. FIGS. 3, 4 and 5 illustrate the comb 20 as originally molded. FIGS. 1 and 2 illustrate the comb 20 after it has been flexed and assembled. In FIG. 1, the comb 20 is shown in its retracted position, in which the comb may be carried very conveniently in a pocket or purse. FIG. 2 shows the comb in its extended position, ready for use.

It will be seen from FIGS. 3–5 that the retractable comb 20 takes the form of an elongated member having first and second end portions at its opposite ends, in the form of a comb portion 22 and a body portion 24, with a flexible handle portion 26 extending therebetween.

The illustrated comb portion 22 comprises a generally flat and rectangular base or supporting member 28 having a plurality of comb teeth 30 projecting upwardly therefrom and formed integrally therewith. The supporting member 28 may also be formed with a longitudinal stiffening fin or flange 32. The comb teeth are arranged in a longitudinal row along the supporting member 28. The comb teeth 30 and the stiffening flange 32 are formed on opposite sides of the supporting member 28.

The body portion 24 is adapted to receive and enclose the comb portion 20. Thus, as shown to advantage in FIGS. 5–9, the body portion 24 includes a lower wall 34 which is flat and generally rectangular and elongated in shape. The lower wall 34 is formed with a plurality of openings or slots 36 for slidably receiving the comb teeth 30. The openings 36 are generally rectangular in shape, with rounded ends, or may be regarded as oval in shape. The openings 36 correspond in shape to the cross-sectional shape of the comb teeth 30. The cross-section of each comb tooth 30 is relatively wide in a direction transverse to the length of the comb portion 22, while being relatively narrow in a direction along the length of the comb portion. Thus, each comb tooth 30 is flat and generally rectangular in cross-section, with rounded edges. It will be evident that each comb tooth 30 may also be regarded as being oval in cross-section.

Each comb tooth 30 has a tapered tip portion 38 with a rounded point 40. The main portion of each tooth 30 also preferably has a slight taper, as will be evident from FIGS. 6–9.

Figure 6:
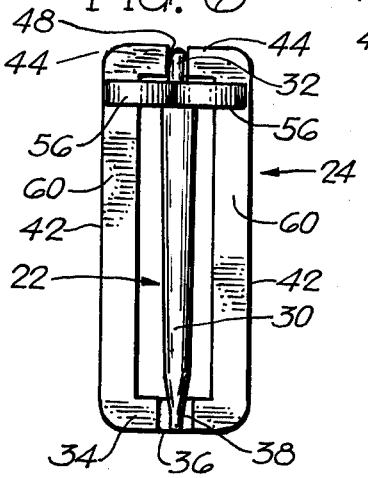
FIG. 6 is an enlarged end view, taken generally as indicated by the line 6—6 in FIG. 1, the comb being shown in its retracted position.
Figure 8:
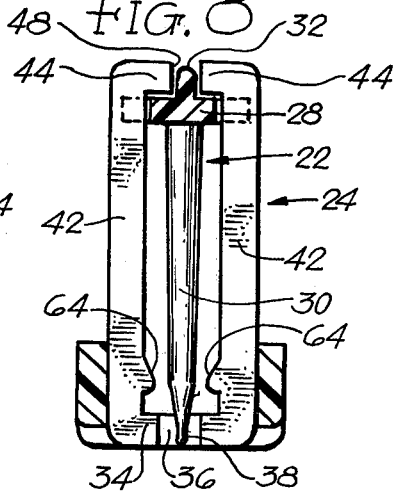
FIG. 8 is a vertical section taken generally along the line 8—8 in FIG. 1, the comb being shown in its retracted position.
Figure 7:
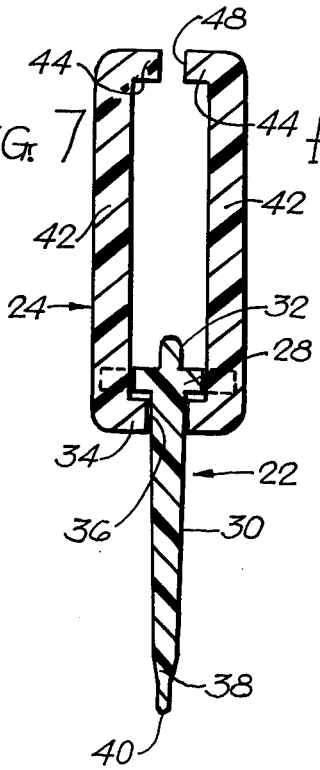
FIG. 7 is an enlarged vertical section, taken generally along the line 7—7 in FIG. 2, the comb being shown in its extended position.

The comb teeth 30 are slidable through the openings 36 between the retracted position of FIGS. 6 and 8 and the extended position of FIGS. 7 and 9. In the extended position, the teeth 30 project through the openings 36, so that they can be used in a normal manner for grooming human or animal hair. In the extended position, the supporting member 28 of the comb portion 22 is adjacent or close to the lower wall 34 of the body portion 24.

The comb teeth 30 are retractable through the openings 36 to the retracted positions of FIGS. 6 and 8, in which the tip portions 38 of the comb teeth 30 are retracted into the openings 36.

The body portion 24 preferably has a pair of sidewalls 42 which enclose the comb teeth 30 and the supporting member 28, when they are in their retracted position, as shown in FIGS. 6 and 8. The sidwalls 42 project upwardly from the lower wall 34 and are formed in one piece therewith. Thus, the body portion 24 may be regarded as generally U-shaped in cross-section. The supporting member 28 is dimensioned so as to slide easily between the sidewalls 42. Means are provided on the comb portion 22 and the body portion 24 to limit the retracting movement of the comb portion. For this purpose, the sidewalls 42 are preferably formed with inwardly projecting stop flanges 44, along the upper edges of the sidewalls 42. The supporting member 28 of the comb portion 22 is provided with upper stop surfaces 46 which are adapted to engage the stop flanges 44 when the comb portion 22 is fully retracted, as shown in FIGS. 6 and 8.

A gap or slot 48 is formed between the inwardly projecting flanges 44, so that the comb portion 22 can be inserted into and assembled with the body portion 24 by flexing the sidewalls 42 outwardly so as to widen the gap 48. The comb teeth 30 are then inserted through the openings 36. After the comb portion 22 has been inserted into and assembled with the body portion 24, the sidewalls 42 are allowed to spring inwardly to their original positions, as shown in FIGS. 6–9, so that the stop flanges 44 will retain the comb portion 22 within the housing formed by the body portion 24. In the retracted position of the supporting member 28, the stiffening fin 32 projects upwardly into the gap 48, as shown in FIGS. 6 and 8.

The handle portion 26 is generally in the form of a flat elongated strip which is generally rectangular in cross-section, as shown in FIG. 10, but may be formed with a pair of small stiffening or reinforcing flanges 50. The handle portion 26 varies in width, as indicated in FIGS. 4 and 5. The cross-section of FIG. 10 is taken at the widest part of the handle portion 26, approximately midway between the comb portion 22 and the body portion 24. The width of the handle portion tapers toward both ends, where the handle portion connects with the comb portion 22 and the body portion 24. The cross-section of FIG. 11 is taken through the handle portion 26 near the comb portion 22. It will be seen that the stiffening fin 32 extends along this part of the handle portion, from the comb portion 22. The stiffening fin 32 has the advantage of substantially obviating the breakage of the handle portion 26 where it joins with the comb portion 22.

Where the handle portion 26 joins with the body portion 24, the handle portion is formed with a pair of reinforcing and stiffening flanges 52 which substantially prevent the breakage of the handle portion at this location. The reinforcing flanges 52 may be regarded as extensions of the flanges 50. The reinforcing flanges 52 are of a considerable depth, so that very little flexing of the handle portion 26 occurs along the region where the handle portion 26 merges with the body portion 24. Twisting is prevented also.

FIGS. 3–5 illustrate the condition of the comb 20 as originally molded. It will be seen that the handle portion 26 is substantially flat, straight and elongated. The longitudinal dimensions of the body portion 24 and the handle portion 26 extend in substantially the same direction. However, the longitudinal dimension of the comb portion 22 is preferably angled downwardly at a small angle, such as about 10°, for example, relative to the longitudinal dimension of the handle portion 26. This angular offset is clearly shown in FIG. 3.

The comb 20 is assembled by flexing the handle portion 26, so that it is generally U-shaped, as shown in FIG. 1. The comb portion 22 is then inserted through the gap 48 in the upper edge of the body portion 24. It is necessary to widen the gap 48 by flexing the sidewalls 42 outwardly. The comb teeth 30 are inserted through the openings 36 in the lower wall 34 of the body portion 24. The sidewalls 42 are then allowed to spring inwardly to their original positions, so that the stop flanges 44 will retain the comb portion 22 within the housing formed by the body portion 24.

As thus assembled, the comb 20 is in its retracted position, as shown in FIGS. 1, 6 and 8. In this position, the comb 20 is highly compact and may be carried very conveniently in a pocket or purse.

The comb 20 may be moved to its extended position by squeezing the handle portion 26, so that the comb teeth 30 are extended through the openings 36. The extended position of the comb 20 is shown in FIGS. 2, 7, 9 and 12. With the comb teeth 30 extended, the comb 20 may be used in the normal manner for grooming human or animal hair.

The tip or end of the supporting member 28 is preferably provided with a pair of laterally projecting flanges 56 which extend outside of and beyond the body portion 24. The illustrated flanges 56 have edge surfaces 58 which are slidable along end surfaces 60 on the body portion 24. The guiding action between the surfaces 58 and 60 tends to keep the comb teeth 30 straight as they are extended and retracted. Moreover, the flanges 56 may be used as handles or finger tabs to be engaged by a finger or thumb of the user, to assist in the extension and retraction of the comb portion 22.

It is preferred to provide means for temporarily holding the comb portion 22 in its extended position. Such means may take the form of detent means on the comb portion 22 and the body portion 24. As shown in FIGS. 8, 9 and 12, the illustrated comb is provided with a pair of detent projections or cams 64, extending inwardly on the sidewalls 42 of the body portion 24, for detaining engagement with the edges of the supporting member 28 on the comb portion 22. As the comb portion 22 is moved downwardly to its fully extended position, the supporting member 28 causes flexure of the sidewalls 42, so that the supporting member 28 is able to snap past the detent projections 64. The comb portion 22 is thus detained in its extended position. The user can return the comb portion 22 to its retracted position by exerting a retracting force on the main handle portion 26, or on the small handles or tabs 56. This retracting force causes the supporting member 28 to snap past the detent projections 64, with accompanying flexure of the sidewalls 42.

As the comb teeth 30 are retracted through the openings 36 in the lower wall 34 of the body portion 24, any loose hairs and other foreign materials are stripped from the comb teeth, so that the comb cleans itself as it is retracted. The loose hairs and other foreign materials fall away from or are easily wiped away from the body portion 24 of the comb 20 after the comb portion 22 has been fully retracted into the body portion.

Thus, after each use, the retractable comb 20 is self-cleaning by the retracting action of the comb. It will be evident that the self-cleaning retractable comb is easy to use, attractive in appearance and low in cost.

It will be understood that the handle portion 26 of the retractable comb 20 serves as a spring to bias the comb portion 22 toward its retracted position. Thus, the comb will remain in its retracted position until the user exerts sufficient force to move the comb portion 22 to its extended position.

I claim:

1. A self-cleaning retractable comb, comprising an elongated member made in one piece of a flexible resilient resinous plastic material, said member having first and second longitudinal end portions formed at opposite ends of said member and taking the form of a comb portion and a body portion, respectively, said member having a flexible elongated handle portion extending longitudinally between said comb portion and said body portion, said comb portion having a plurality of transversely projecting comb teeth formed integrally thereon and arranged in a longitudinal row, said body portion having a longitudinal wall formed with a plurality of transverse openings therein for receiving said teeth, said openings being arranged in a longitudinal row, said teeth being slidably received in said openings for transverse extending and retracting movement between an extended position with said teeth projecting through said openings and a retracted position with the tips of said teeth retracted into said openings, said body portion having sidewall means extending transversely from said longitudinal wall for enclosing said teeth when said teeth are in said retracted position, said handle portion being flexed transversely into a generally U-shaped longitudinal loop when said teeth are in said retracted position, said comb portion and said body portion having inner longitudinal ends connected integrally to opposite longitudinal ends of said U-shaped loop, said flexible handle portion serving as a spring affording a resilient biasing action to urge said comb portion and said teeth toward said retracted position, said member having stop means for limiting the retracting movement of said comb portion due to said resilient biasing action, said longitudinal wall of said body portion being effective to clean said teeth when said teeth are retracted into said openings.

2. A self-cleaning retractable comb according to claim 1, in which said comb portion and said body portion include means for temporarily holding said teeth in said extended position.

3. A self-cleaning retractable comb according to claim 1, in which said comb portion and said body portion include detent means for detaining said comb portion with said teeth in said extended position.

4. A self-cleaning retractable comb according to claim 3, in which said detent means include inwardly extending projections on said sidewall means for engaging and detaining said comb portion with said teeth in said extended position.

5. A self-cleaning retractable comb according to claim 1, in which said stop means includes a pair of stop flanges projecting from said sidewall means and engageable by said comb portion in the retracted position thereof.

6. A self-cleaning retractable comb according to claim 5, in which said stop flanges are formed to provide a gap therebetween through which said comb portion can be inserted by flexing said sidewall means in the assembly of said comb portion with said body portion.

7. A self-cleaning retractable comb according to claim 1, in which said comb portion includes end tab means projecting from the outer end of said comb portion and beyond the outer end of said body portion for use in manipulating said comb portion between said retracted and extended portions.

8. A self-cleaning retractable comb according to claim 7, including slidably engaging guide surfaces on said tab means and the outer ends of said sidewall means of said body portion for guiding the extending and retracting movements of said comb portion, said tab means being of greater width than said comb portion to provide said guide surfaces on said tab means.

9. A self-cleaning retractable comb, comprising an elongated member made in one piece of a flexible resilient resinous plastic material, said member having first and second longitudinal end portions formed at opposite ends of said member and taking the form of a comb portion and a body portion, respectively, said member having a flexible elongated handle portion extending longitudinally between said comb portion and said body portion, said comb portion having a plurality of transversely projecting comb teeth formed integrally thereon and arranged in a longitudinal row, said body portion having a longitudinal wall formed with a plurality of transverse openings therein for receiving said teeth, said openings being arranged in a longitudinal row, said teeth being slidably received in said openings for transverse extending and retracting movement between an extended position with said teeth projecting through said openings and a retracted position with the tips of said teeth retracted into said openings, said body portion having a pair of spaced sidewalls extending transversely from said longitudinal wall for enclosing said teeth when said teeth are in said retracted position, said comb portion being movable between said sidewalls, said handle portion being transversely flexed into a generally U-shaped longitudinal loop when said teeth are in said retracted position, said comb portion and said body portion having inner longitudinal ends connected integrally to opposite longitudinal ends of said U-shaped loop, said flexed handle portion serving as a spring affording a resilient biasing action to urge said comb portion and said teeth toward said retracted position, said member having stop means for limiting the retracting movement of said comb portion due to said resilient biasing action, said longitudinal wall of said body portion being effective to clean said teeth when said teeth are retracted into said openings, said stop means including a pair of opposed stop flanges projecting inwardly from said respective sidewalls and engageable by said comb portion in the retracted position thereof, said stop flanges having a gap therebetween through which said comb portion can be inserted by flexing said sidewalls in the assembly of said comb portion with said body portion.

10. A self-cleaning retractable comb, comprising an elongated member made in one piece of a flexible resilient resinous plastic material, said member having first and second longitudinal end portions formed at opposite ends of said member and taking the form of a comb portion and a body portion, respectively, said member having a flexible elongated handle portion extending longitudinally between said comb portion and said body portion, said comb portion having a plurality of transversely projecting comb teeth formed integrally thereon and arranged in a longitudinal row, said body portion having a longitudinal wall formed with a plurality of transverse openings therein for receiving said teeth, said openings being arranged in a longitudinal row, said teeth being slidably received in said openings for transverse extending and retracting movement between an extended position with said teeth projecting through said openings and a retracted position with the tips of said teeth retracted into said openings, said body portion having a pair of spaced sidewalls extending transversely from said longitudinal wall for enclosing said teeth when said teeth are in said retracted position, said comb portion being movable between said sidewalls, said handle portion being flexed transversely into a generally U-shaped longitudinal loop when said teeth are in said retracted position, said comb portion and said body portion having inner longitudinal ends connected integrally to opposite longitudinal ends of said U-shaped loop, said flexed handle portion serving as a spring affording a resilient biasing action to urge said comb portion and said teeth toward said retracted position, said member having stop means for limting the retracting movement of said comb portion due to said resilient biasing action, said longitudinal wall of said body portion being effective to clean said teeth when said teeth are retracted into said openings, said stop means including a pair of opposed stop flanges projecting inwardly from said respective sidewalls and engageable by said comb portion in the retracted position thereof, said stop flanges having a gap therebetween through which said comb portion can be inserted by flexing said sidewalls in the assembly of said comb portion with said body portion, said comb portion and said body portion including detent means for detaining said comb portion with said teeth in said extended position, said detent means including inwardly extending projections on said sidewalls for engaging and detaining said comb portion with said teeth in said extended position.

11. A self-cleaning retractable comb according to claim 70, in which said comb portion includes an end tab projecting from the outer end of said comb portion and beyond the outer end of said body portion for use in manipulating said comb portion between said retracted and extended positions.

12. A self-cleaning retractable comb according to claim 11, including slidably engaging guide surfaces on said tab and the outer ends of said sidewalls of said body portion for guiding the extending and retracting movements of said comb portion, said tab being of greater width than said comb portion to provide said guide surfaces on said tab.

* * * * *

UNITED STATES PATENT OFFICE

CERTIFICATE OF CORRECTION

Patent No. 4,147,174 Dated April 3, 1979

Inventor(s) Lester R. Peilet

It is certified that error appears in the above-identified patent and that said Letters Patent are hereby corrected as shown below:

In column 8, line 33, "70" should be -- 10 --

Signed and Sealed this

*Eleventh* Day of *September 1979*

[SEAL]

*Attest:*

*Attesting Officer*

LUTRELLE F. PARKER

*Acting Commissioner of Patents and Trademarks*